US007114457B1

(12) United States Patent
Stiers

(10) Patent No.: US 7,114,457 B1
(45) Date of Patent: Oct. 3, 2006

(54) WAKEBOARD JUMP ENHANCEMENT SYSTEM

(76) Inventor: Luke D. Stiers, 555 Amarpal Ct., Yuba City, CA (US) 95993

( * ) Notice: Subject to any disclaimer, the term of this patent is extended or adjusted under 35 U.S.C. 154(b) by 0 days.

(21) Appl. No.: 11/021,502

(22) Filed: Dec. 22, 2004

(51) Int. Cl.
*B63B 21/04* (2006.01)

(52) U.S. Cl. ..... 114/253

(58) Field of Classification Search ..... 114/253
See application file for complete search history.

(56) References Cited

U.S. PATENT DOCUMENTS 4,127,247 A * 11/1978 Strasilla ..... 244/152
4,722,497 A 2/1988 Stanford
4,738,414 A 4/1988 McCulloh
5,217,186 A 6/1993 Stewart
5,249,998 A * 10/1993 Woolley et al. ..... 441/65
5,366,182 A 11/1994 Roeseler
5,472,394 A 12/1995 Michaelson
5,816,184 A 10/1998 McCulloh
5,934,217 A * 8/1999 Allsop ..... 114/242
D501,238 S * 1/2005 Peterson ..... D21/769
2002/0046690 A1 4/2002 Roeseler
2004/0065780 A1* 4/2004 Bellacera ..... 244/155 A
2004/0262449 A1* 12/2004 Rebelle ..... 244/4 A

* cited by examiner

*Primary Examiner*—Stephen Avita
(74) *Attorney, Agent, or Firm*—Heisler & Associates

(57) ABSTRACT

A jump enhancement system is provided for use while riding upon a water or snow planing apparatus towed behind a boat or snowmobile. The system includes an aerodynamic lift generator, such as a parachute, coupled to the user. Most preferably, a flotation or padded/insulated vest is provided which includes leg harnesses and which can be worn by the user with a cord collector coupled to the flotation vest and securing a cord to the flotation or padded/insulated vest which also extends to the parachute. The cord collector is biased to cause the cord to be collected adjacent the user when no drag forces are exerted upon the parachute. When any such drag forces are experienced, the cord is deployed out of the cord collector so that the parachute is deployed. The parachute is thus in position to enhance a height and duration of jumps off of the surface.

27 Claims, 4 Drawing Sheets

WAKEBOARD JUMP ENHANCEMENT SYSTEM

FIELD OF THE INVENTION

The following invention relates to entertainment systems associated with boating and snowboarding and involving being towed behind a boat or snowmobile while planing over a water or snow surface. More particularly, this invention relates to systems for exerting lifting forces upon a user as the user is towed behind a boat or snowmobile for enhancement of the height and duration of jumps experienced by the user.

BACKGROUND OF THE INVENTION

One of the desirable aspects of boating involves practicing various different activities while being towed behind the boat and planing on the surface of the water through some form of towable water planing apparatus. While such activity originally was restricted primarily to water skiing, numerous other activities have gained popularity which are practiced while being towed behind a boat. Such activities include knee boarding, where a user kneels upon a board and is towed behind the boat with a standard tow rope; tubing, where a user rides upon an air-filled inner tube or other inflatable structure which planes upon the surface of the water while being connected to the boat either directly or through hands of the user; and more recently, wakeboarding. With wakeboarding, the user typically has both feet secured to a relatively wide board (i.e. greater than one foot wide) and with the user towed by a boat at typically a slower speed than is involved with water skiing. One activity enjoyed by a wakeboarder is traversing the wake of the boat and becoming airborne.

Numerous apparatuses have been developed to enhance the height and duration of jumps enjoyed by a wakeboarder. Such devices include devices to enhance a size of the wake, so that a greater amount of lifting force can be generated by the user riding up over the wake. Other devices involve towers or poles to cause a tow rope to be suspended from a higher point so that towing forces from the boat have a substantial lifting component acting upon the user. With the utilization of such devices, an accomplished wakeboarder can perform numerous tricks including flips, spins, and other enjoyable activities.

Unfortunately, even with the best of wake size conditions and pole or tower arrangements, jumps experienced by wakeboard users are still relatively limited in height and duration. Thus, these desirable jumps are limited to only a small portion of the overall wakeboarding experience. Accordingly, a need exists for systems for further enhancing height and duration of jumps which can be experienced by a wakeboarder. Such systems could optionally be enjoyed not only by wakeboarders, but also by users of water skis, knee boards, inner tubes, or other water surface planing apparatuses, as well as users of snowboards or skiers on snow who jump over snow ramps, either with or without being towed by a vehicle.

One sport which provides an extreme level of elevation while being towed behind a boat is the sport of parasailing. With parasailing, a modified parachute, called a parasail, is deployed behind a boat with the parasail riding above and to the rear of the boat due to a combination of lift and drag forces exerted upon the parasail. A cord extending between the parasail and the boat has a midpoint thereon where a user or group of users are located. The user or group of users are either wearing a harness or supported within some form of platform which is coupled to this cord, or otherwise coupled to both the parasail and the boat so that the parasail and boat are always secured to each other.

Parasailing is unique from wakeboarding and other water sports enjoyed behind a motorboat in that the user does not plane upon the surface. Also, the user does not exercise any control, with all control being employed by the driver of the boat and any other personnel controlling a length of the cord extending from the boat to the parasail. Reducing the size of a parasail, or a speed of the boat so that a user would ride upon the surface is not a practical solution. If a user were to fall, the user would have no way of releasing from the boat, and would experience undesirable dragging through the water until the driver of the boat realized that the user had fallen. Hence, while parasail configurations provide an enjoyable activity of their own, such parasail devices are distinct from other boat towed activities which involve the user borne upon a water planing apparatus where the user exhibits a significant level of control over the activity.

SUMMARY OF THE INVENTION

With this invention, an aerodynamic lift generator is provided which is coupled to a user while the user is involved in riding upon a towable water planing apparatus, such as a wakeboard or upon a towable snow planing apparatus such as snowboards or skis. The aerodynamic lift generator exerts lifting forces upon the user so that any jumps experienced by the user exhibit a greater height and duration. A boat, snowmobile or other tow craft is provided with a tow rope having a handle adapted to be grasped by the user in a releasable fashion. The user employs some form of water or snow planing apparatus so that the user can ride upon the surface of the water or snow while holding onto the tow rope and being pulled by the tow craft. The aerodynamic lift generator is preferably coupled to the user through a harness so that the user's hands are free to hold the tow rope. The aerodynamic lift generator is preferably in the form of a parachute with the parachute preferably having been modified to include vents and stabilizers in appropriate locations so that the parachute will tend to exhibit an enhanced lifting force and prevent rotation, to maximize the lift generating effect for a relatively small size of canopy for the parachute.

Most preferably, the aerodynamic lift generator is coupled to the harness, or otherwise to the user, through a cord coupled to a retractor which can selectively retract and deploy the cord therefrom. The retractor includes a spring or other biasing means which allows the cord to be deployed out of the retractor when drag forces are experienced by the parachute or other aerodynamic lift generator, such as when the boat or other tow craft is moving, but which retractor causes the cord to be collected when no such drag forces are being exerted upon the aerodynamic lift generator, such as when the user is at rest. With the retractor, the aerodynamic lift generator is caused to stay close to the user when the user is in the water at rest, but allows the aerodynamic lift generator to be deployed away from the user for maximum lifting force exertion when the user is effectively planing upon the surface and the tow craft is moving.

OBJECTS OF THE INVENTION

Accordingly, a primary object of the present invention is to enhance a height and duration of jumps experienced by a user of water or snow planing apparatus while the user is towed behind a boat, snowmobile or other tow craft.

Another object of the present invention is to provide a jump enhancement system which does not require modification of the boat or other tow craft.

Another object of the present invention is to provide a jump enhancement system which does not require modification of a boat or other tow craft tow rope.

Another object of the present invention is to provide a jump enhancement system which can be utilized with various different forms of water or snow planing apparatuses.

Another object of the present invention is to provide a jump enhancement system which is safe for a user and other boaters and people in the general vicinity.

Another object of the present invention is to provide a boating and boarding entertainment system which can cause a user of a water or snow planing apparatus to experience higher and longer duration jumps off of a surface of the water or snow.

Another object of the present invention is to provide a jump enhancement system which does not affect a difficulty level in pulling the user out of the water and into a planing position upon the water planing apparatus.

Another object of the present invention is to provide a boating and boarding entertainment system which is easy to use.

Other further objects of the present invention will become apparent from a careful reading of the included drawing figures, the claims and detailed description of the invention.

DESCRIPTION OF THE PREFERRED EMBODIMENT

Figure 4:
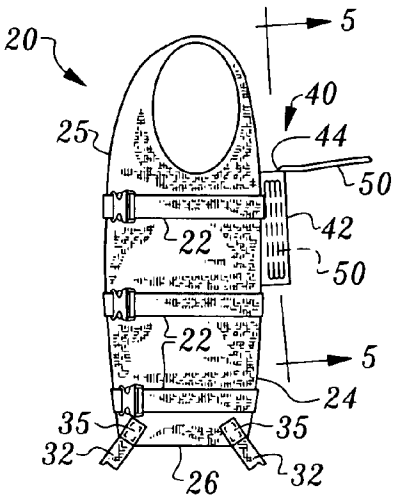
FIG. 4 is a side elevation view of that which is shown in FIG. 2.

Referring to the drawings, wherein like reference numerals represent like parts throughout the various drawing figures, reference numeral 10 is directed to a jump enhancement system (FIG. 1) for use by a user U riding upon a wakeboard W or other water or snow planing apparatus riding upon a surface S of the water or snow while the user U is towed behind a boat B or other tow craft through a tow rope R. With this system 10, the user U can experience jumps of greater height and duration (FIGS. 10 and 11) than could otherwise be experienced.

In essence, and with particular reference to FIGS. 1–5, basic details of the jump enhancement system 10 according to the preferred embodiment are described. In its broadest sense, the overall system 10 includes a boat or other tow craft B driven by a driver D upon a surface S of the water or snow. A tow rope R extends from a rear of the boat or other tow craft B and is held by a user U standing upon a wakeboard W or other water or snow planing apparatus. A flotation or padded vest 20 is worn by the user U which preferably includes leg harnesses 30. A cord collector 40 (FIGS. 3–5) is coupled to a rear of the flotation or padded vest 20. The cord collector 40 supports a cord 50 therein and includes a spring 60 which biases a position of the cord 50 toward a collected position within the cord collector 40. The cord 50 extends to a parachute 70 with the parachute 70 causing the cord 50 to be deployed away from the cord collector 40 so that the parachute 70 rides above and to a rear of the user U. In this way, the parachute 70 exerts a lifting force upon the user U, causing a height and duration of jumps experienced by the user U to be enhanced.

Figure 2:
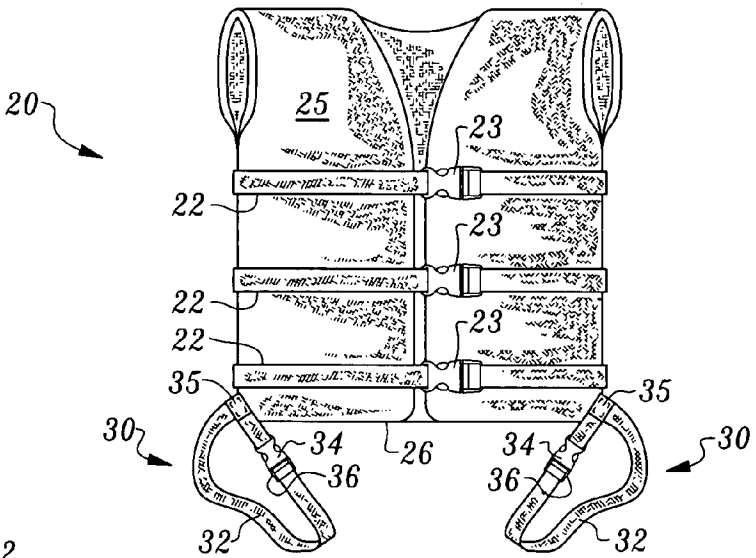
FIG. 2 is a front elevation view of a flotation vest portion of the system of this invention according to the preferred embodiment.
Figure 3:
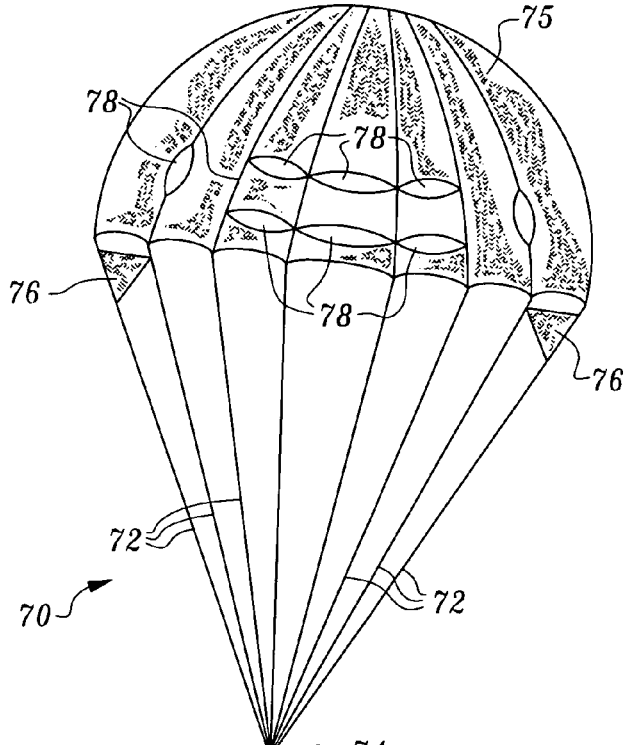
FIG. 3 is a rear elevation view of that which is shown in FIG. 2, and additionally showing the cord and parachute of the system according to a preferred form of this invention.
Figure 3:
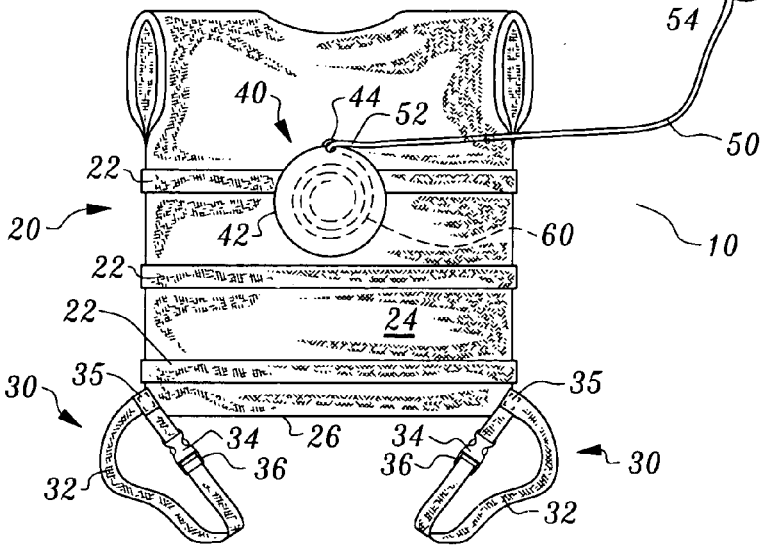

More specifically, and with particular reference to FIGS. 2–4, details of the flotation/padded vest 20 are described. Most preferably, the parachute 70 or other aerodynamic lift generator is coupled to the user U through the flotation/padded vest 20. Alternatively, the parachute 70 or other aerodynamic lift generator could be coupled to the user U in other ways, such as by the user U holding the parachute 70 through a cord 50 or other line grasped by the user U, or with a separate harness and separate flotation/padded vest, rather than the integrated flotation vest 20 of the preferred embodiment of this invention.

With this flotation/padded vest 20, in addition to buoyancy or padded material, straps 22 are provided which gird a torso of the user U and are secured with clips 23. Preferably, multiple such straps 22 and clips 23 are provided for a secure fit of the flotation or padded vest 20 about a torso of the user U. A rear surface 24 of the flotation/padded vest 20 is generally planar and supports the cord collector 40 thereon. The cord collector 40 is preferably secured so that it is not capable of breaking away from the flotation/padded vest 20, such as by sufficient stitching to support weight loads of the use U when the user U is suspended beneath the parachute 70 or other aerodynamic lift generator through the rear surface 24 of the flotation vest 20. The flotation vest 20 includes a front surface 25 opposite the rear surface 24. A lower edge 26 defines a lowermost portion of the flotation or padded vest 20.

Preferably, leg harnesses 30 are secured to the flotation vest 20 with the leg harnesses 30 secured through stitch coupling patches 35 near the lower edge 26 of the flotation vest 20 and at midpoints on the flotation vest 20 between the rear surface 24 and front surface 25. The leg harnesses 30 preferably include belts 32 of sufficient length to gird each of the legs of the user. Clasps 34 are provided so that the belt 32 can be attached and detached quickly from about the legs of the user U. Adjusters 36 are provided along the belts 32 so that a length of each of the belts 32 can be adjusted for a secure fit about the legs of the user U.

Figures 10, 11:
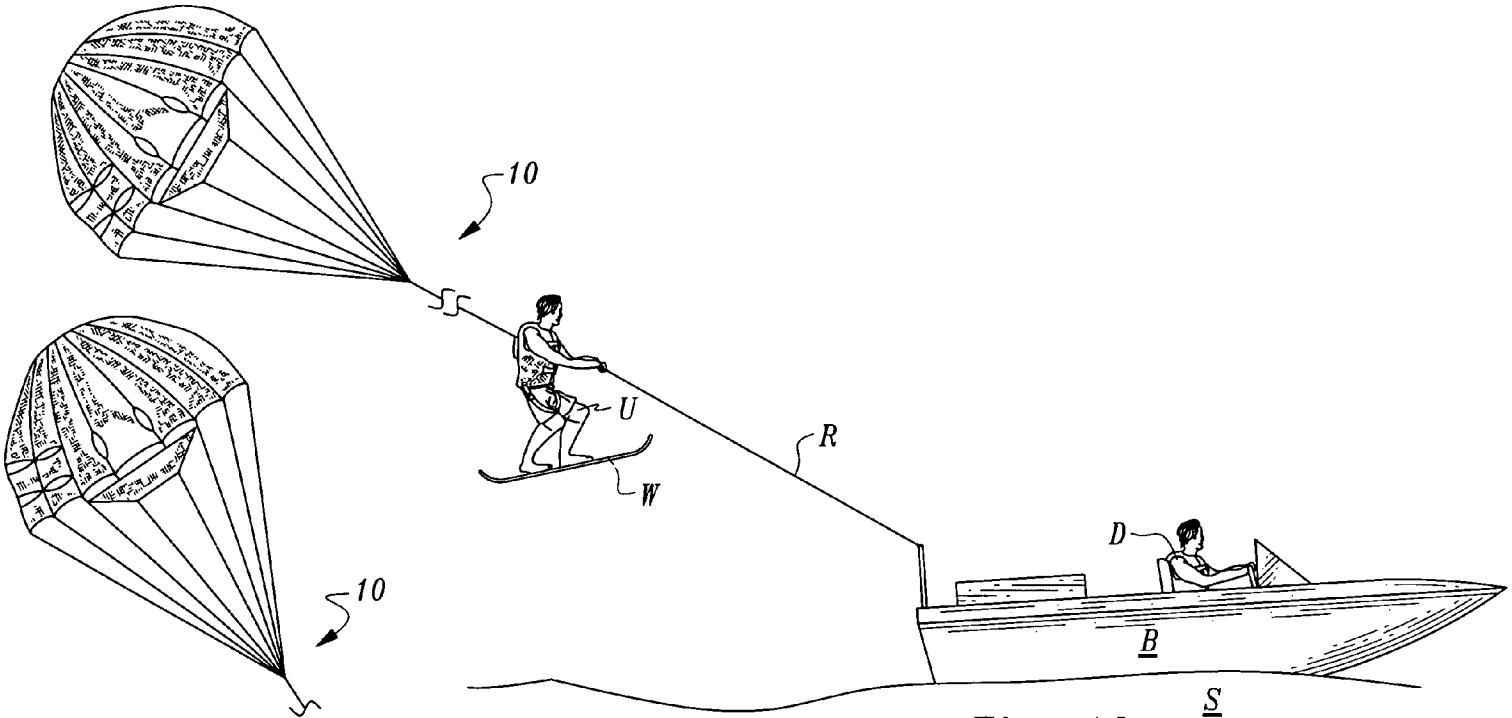

The leg harnesses 30 beneficially allow the user U to be held in a comfortable suspended form beneath the parachute 70 or other aerodynamic lift generator, especially during the end of an enhanced height and duration jump (FIG. 11). In this mode, the leg harnesses 30 are acting similarly to leg supporting potions of a standard harness which might be provided with a skydiving parachute, or with a climbing harness.

While the leg harnesses 30 are preferably configured as shown, various different configurations for the leg harnesses 30 could be provided. Also, the flotation or padded vest 20 could be provided without leg harnesses 30, provided that the straps 22 are sufficiently tight and the user U is willing to abide by any forces being held by a torso of the user U rather than by legs of the user U. The flotation/padded vest 20 could be provided with zippers or other fasteners than the straps 20, and be fitted more tightly to the body of the user U, such that the leg harnesses 30 are less necessary, or to provide additional support in combination with the leg harnesses 30.

Most preferably, the flotation/padded vest 20 is provided so that both attachment to the parachute 70 or other aerodynamic lift generator is provided along with the safety of any personal flotation device or with the padding and protection provided with snow equipment. As an alternative, the flotation/padded vest 20 could be eliminated, and the user could merely utilize a harness. As an alternative to such a harness, the user U could hold the aerodynamic lift generator, such as through the cord 50 with one hand, while the other hand of the user U holds the tow rope coupled to the boat or other tow craft B.

Figure 5:
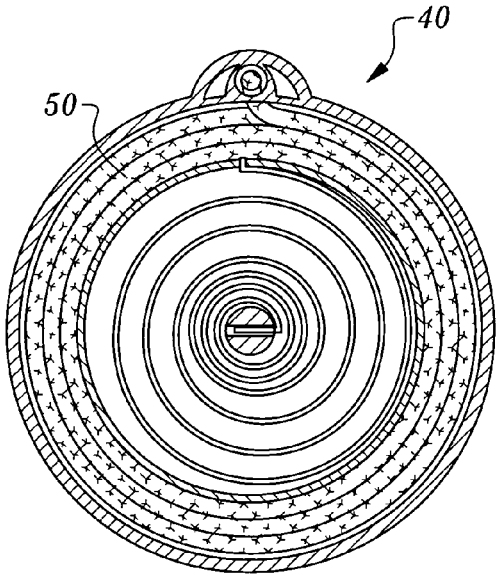
FIG. 5 is a full sectional view of a cord collector of this invention revealing interior details thereof.

With particular reference to FIGS. 3–5, details of the cord collector 40 are described. The cord collector 40 provides a preferred form of a means to couple the cord 50 and associated aerodynamic lift generator to the user U. The cord collector 40 could be replaced with a fixed attachment of the cord 50 to the flotation vest 20 or to a harness, such as with the standard attachment of a parachute to a harness for skydiving.

With the cord collector 40 of the preferred embodiment, a cover 42 is provided which provides the cord collector 40 with a substantially complete enclosure. A port 44 is provided from which the cord 50 can be deployed out of the cord collector 40 and collected within the cord collector 40. A hub 46 is located within the cover 42 with a generally cylindrical concentric form about a post 48 and a center of the cord collector 40. The cord 50 is collected on an outboard surface of the hub 46 with the spring 60 or other bias located inboard of the hub 46.

The hub 46 preferably includes a slit 47 and the post 48 preferably includes a slot 49. The slit 47 is adapted to receive an outside tab 64 of the spring 60 and the slot 49 is adapted to receive an inside tab 62 of the spring 60. In this way, the spring 60, preferably configured as a torsion spring, is supported between the post 48 and the hub 46. The hub 46 is allowed to rotate relative to the post 48. The post 48 is secured to the cover 42 and to the flotation vest 20 without rotation.

While the torsion spring 60 provides a preferred form of bias for the cord collector 40, other forms of springs could be provided, or other items to bias the cord collector 40 toward retracting the cord 50 within the cord collector 40. Preferably a level of retraction force is exerted on the cord 50 which is just enough to overcome friction forces discouraging the hub 46 from rotating, and discouraging the cord 50 from passing through the port 44. In this way, the cord 50 generally remains deployed away from the cord collector 40 except when the user U is completely at rest.

When the user U is at rest, the spring 60 or other bias has sufficient force to draw the cord 50 into the cord collector 40 and draw the parachute 70 or other aerodynamic lift generator back to a location adjacent the user U. Such an arrangement is desirable in that when the parachute 70 or other aerodynamic lift generator is being utilized, but the user U falls, the user U will typically release the tow rope R and the boat or other tow craft B will be away from the user U for a short period of time. As the boat or other tow craft B comes back to the user U, the boat or other tow craft B will typically go around the user U to allow the rope R to come back to the user U. The parachute 70 or other aerodynamic lift generator would create a hazard for the boat or other tow craft B, as well as other tow craft in the general vicinity if the parachute 70 or other aerodynamic lift generator remained a significant distance away from the user U.

By providing the cord collector 40, the parachute 70 or other aerodynamic lift generator remains close to the user U so that this problem is avoided. Furthermore, by having the cord 50 collected within the cord collector 40, the parachute 70 or other aerodynamic lift generator is less likely to hamper the ability of the user U to mount the wakeboard W or other water or snow planing apparatus when initially towed by the boat B or other tow vehicle.

While the cord collector 40 shown in FIGS. 3–5 provides the preferred form of cord collector 40, other cord collectors having different configurations could be utilized, other than those drawing the cord 50 into a cylindrical spooled configuration and utilizing different biasing structures. For instance, the cord 50 could be collected merely by the user U pulling the cord 50 toward the user U until the parachute 70 or other aerodynamic lift generator is located adjacent the user U and so that the user U is again ready to mount the wakeboard or other water or snow planing apparatus in a safe and effective fashion with the parachute 70 or other aerodynamic lift generator close to the user U initially.

Figure 1:
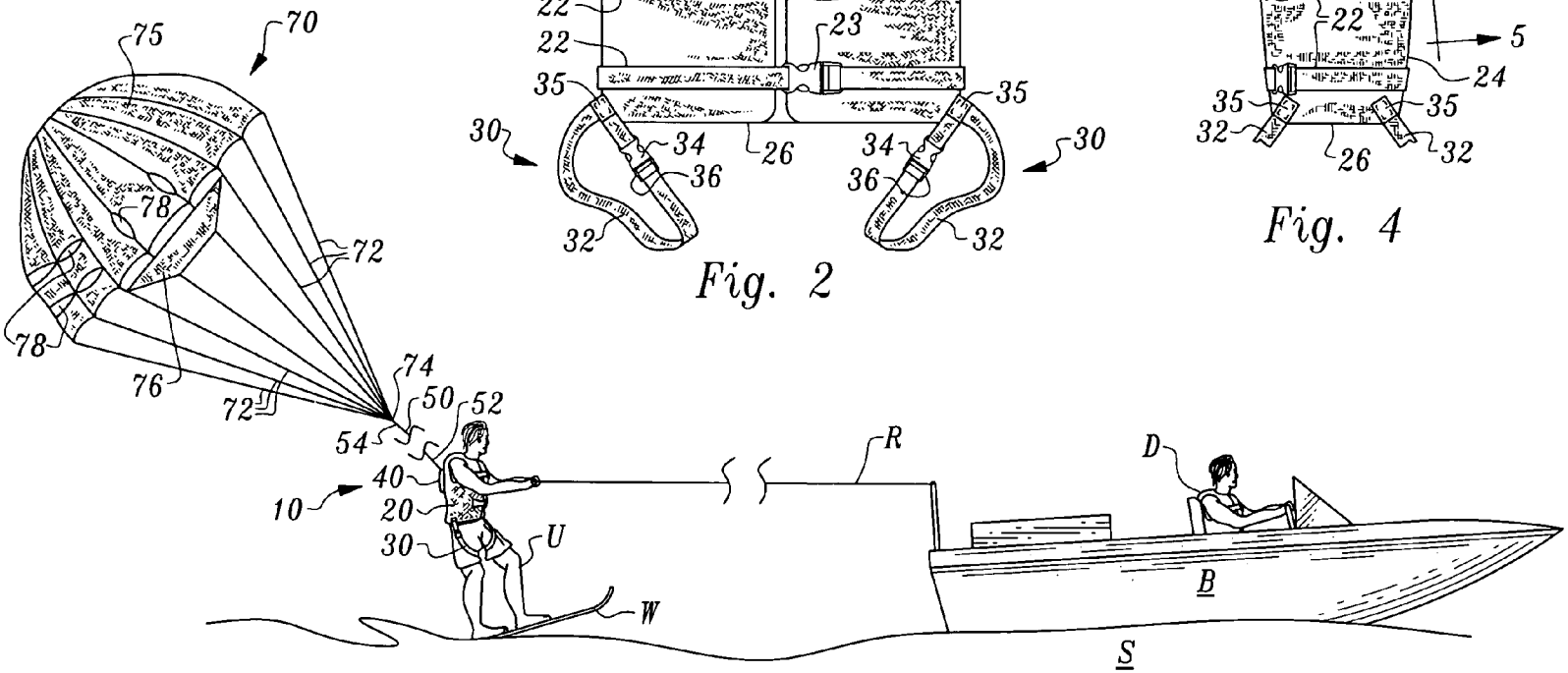
FIG. 1 is a perspective view of the system of this invention according to a preferred embodiment with the system shown in use and before a jump is being executed.

With particular reference to FIGS. 1 and 3, details of the parachute 70 are described. The parachute 70 provides a preferred form of aerodynamic lift generator according to this invention. However, other forms of aerodynamic lift generators could also be provided. For instance, the parachute 70 could be augmented or replaced with a kite formed of a combination of rigid and flexible members, a balloon, an at least semi-rigid air foil, such as a rigid wing or a semi-inflatable wing, or a semi-fabric formed wing. At a minimum, the aerodynamic lift generator is of such a configuration that at least when the user U is experiencing forward velocity by being towed by the rope R connected to the boat or other tow vehicle B, the aerodynamic lift generator causes such velocity to induce an upward force which can be exerted upon the user U through the cord 50 or other coupling of the aerodynamic lift generator to the user U.

Most preferably, this aerodynamic lift generator is in the form of the parachute 70. This parachute 70 is most specifically generally similar in shape and configuration to a parasail, in that it includes vents 78 asymmetrically located on lower portions of a canopy 75 of the parachute 70, and stabilizers 76 located on lateral sides of the parachute 70. Lines 72 extend from a junction 74 where the parachute 70 joins the cord 50 back to the canopy 75. The stabilizers 76 are located upon the lines 72 and spaced slightly from the canopy 75. The stabilizers 76 act to discourage the parachute 70 from rotating. In this way, the stabilizers 76 keep the vents 78 at a lowermost portion of the canopy 75 of the parachute 70.

Because air collecting within the canopy 75 is only allowed to be vented through the vents 78 on the lower rear portion of the canopy 75, the canopy 75 is caused to rise up to a more elevated position above the user U. However, drag forces exerted upon the parachute 70 cause the parachute 70 to trail behind the user U somewhat. This orientation of the parachute 70 relative to the user U varies when the user U experiences jumps and when other dynamic relative positions and speeds of the user U, boat or other tow craft B and parachute 70 are experienced.

Most preferably, the parachute 70 is significantly smaller than a full size parasail, being about three feet across. In this way, the parachute 70 does not maintain sufficient lifting force to keep the user U above the surface S of the water.

Rather, the parachute 70 only enhances a height of jumps experienced by the user U. In an alternative embodiment, it is conceivable that the parachute 70 could be enlarged in size, or the boat or other tow craft B driven at sufficient speed so that the lifting force would keep the user U above the surface S of the water or ground. The cord 50 is preferably about ten to thirty feet long with the lines 72 of the parachute 70 approximately five feet long, so that the entire parachute 70 rides no more than thirty to forty feet above a surface S of the water. At such an elevation, power lines typically suspended over a body of water are sufficiently high that any risk of hazardous contact is avoided.

While the parachute 70 is preferably coupled to the user U through the cord 50, the parachute 70 could be directly coupled to the user U. Particularly, when the aerodynamic lift generator is in the form of wings, such wings could be mounted to the user U in a more rigid fashion, such as being mounted to shoulder supports on the flotation vest 20 or other wearable structure worn by the user U. Thus, the cord 50 can alternatively either be eliminated or replaced with rigid couplings.

Figure 6:
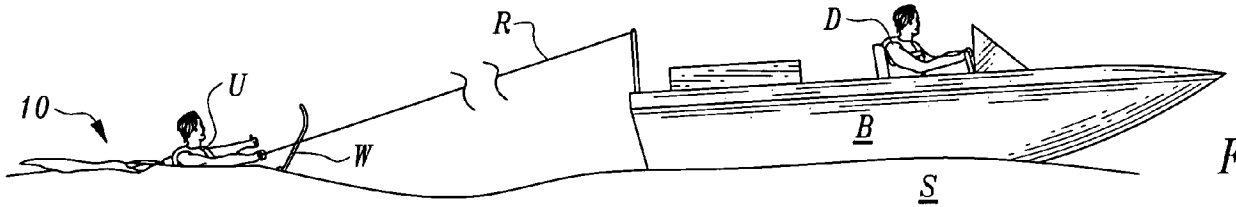
FIGS. 6–11 are perspective views of the system of this invention according to a preferred embodiment showing sequential stages in the use of the invention.
Figure 7:
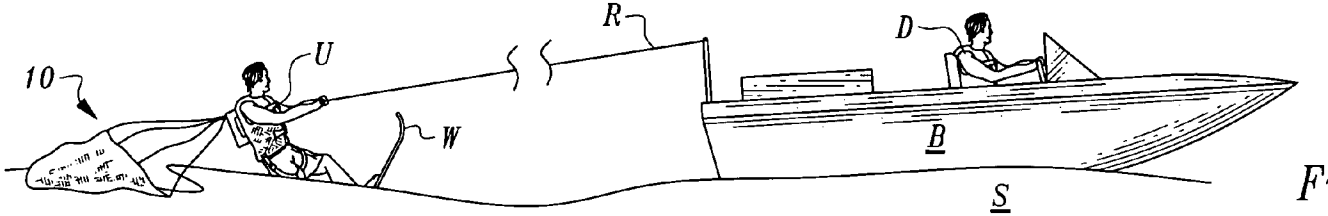
Figure 8:
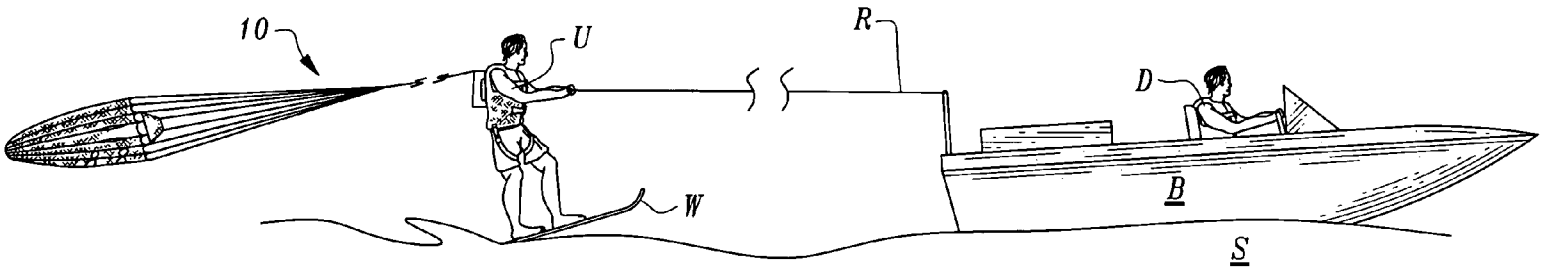
Figure 9:
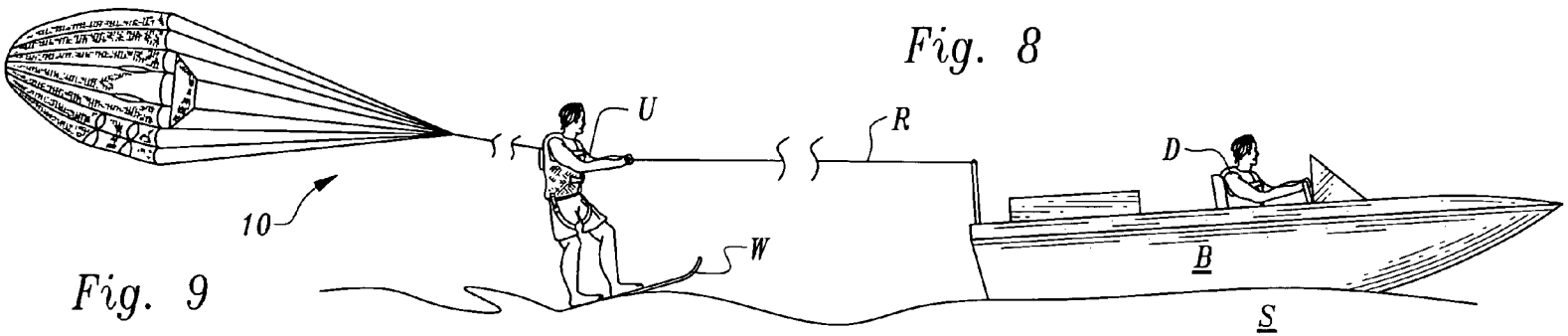

In use and operation, and with particular reference to FIGS. 1 and 6–11, various steps in the operation of the method of this invention are described. Initially, and as shown in FIG. 6, the user U is down beneath the surface S of the water or on the ground and the boat or other tow craft B is at rest. The user U wears the flotation or padded/insulated vest 20 with the cord collector 40 thereon and with the cord 50 entirely collected within the cord collector 40 so that the parachute 70 is directly adjacent the user U. As the boat or other tow craft begins to move (FIG. 7) the user U begins to climb up onto the surface S of the water or snow and plane upon the wakeboard W or other water or snow planing apparatus. Because the parachute 70 is directly adjacent the user U, the parachute 70 is quickly brought up out of the water or snow and above the surface S of the water or snow. Any water or snow tending to collect within the parachute 70 can cause the parachute 70 to more quickly deploy away from the user U by deployment of the cord 50 out of the cord collector 40, while the vents 78 beneficially allow water or snow to drain quickly out of the parachute 70. Once the user U has fully mounted upon the wakeboard W or other water or snow planing apparatus upon the surface S of the water or snow, and the boat or other tow craft B is still gaining speed, the parachute 70 will have fully climbed out of the water or snow.

As the boat or other tow craft B picks up additional speed, the canopy 75 of the parachute 70 is caused to open to a greater and greater extent. Also, the vents 78 and stabilizers 76 of the parachute 70 act to cause the parachute 70 to be fully filled and take a position at equilibrium above and to the rear of the user U (FIG. 1). While the parachute 70 is shown directly adjacent the user U for convenience in FIG. 1, the parachute 70 would actually typically be about ten to thirty feet away from the user U, at a position about five to twenty feet behind the user U and five to fifteen feet above the user U.

As the parachute 70 fills with air, it exerts significant drag upon the user U. However, this significant drag is not experienced by the user U until the user U is typically fully planing up upon the surface S of the water or snow. When the user U is mounting the wakeboard W or other water or snow planing apparatus, significant forces are exerted upon the hands of the user U by the tow rope R because the boat or other tow craft B is moving faster than the user U initially. This period of maximum stress is relieved once the user U is planing upon the wakeboard W or other water or snow planing apparatus upon the surface S of the water or snow. Shortly after such planing occurs, a second period of maximum stress occurs by drag forces exerted upon the parachute 70 pulling rearwardly upon the cord 50, and hence the user U. The parachute 70 is sized and a speed of the boat or other tow vehicle B selected so that this second period of maximum stress upon the user U is no greater than the first period of maximum stress, so that the user U can comfortably maintain secure grip upon the tow rope R, such as through a handle.

The user U can then maneuver in the same fashion as the user U would typically maneuver, except that the parachute 70 is causing the user U to be somewhat lighter upon the surface S of the water or snow. Hence, the wakeboard W or other water or snow planing apparatus would tend to plane a little bit more completely upon the surface S of the water or snow. When the user U steers the wakeboard W or other water or snow planing apparatus across the wake of the boat or other tow vehicle B, or otherwise over any surface tending to cause the wakeboard or snowboard/skis W and user U to jump off of the surface S of the water or snow, this jump is enhanced in height and duration due to lifting forces caused by the parachute 70 or other aerodynamic lift generator (FIG. 10).

If desired, this enhancement can be further augmented by the driver D of the boat or other tow craft B accelerating at the moment of jump, so that the user U can extend the height and/or distance and duration of the jump. Toward the end of the jump, the user U will typically have caused the parachute 70 to climb up to a higher elevation along with the user U. As the user U begins to fall under gravitational forces (FIG. 11) the parachute 70 will typically be caused to rotate to a position more overhead of the user U. Thus, the parachute 70 acts to decrease a rate of fall of the user U back down towards the surface S of the water or snow. The parachute 70 or other aerodynamic lift generator thus acts to reduce the rate of descent of a user U and allows a user U to more effectively land successfully upon the surface S of the water or snow and remain mounted upon the wakeboard W or other water or snow planing apparatus, in spite of the particularly high and long jumps experienced by the user U.

As can readily be seen, the lifting force exerted by the aerodynamic lift generator of this invention can be increased by increasing a size of the aerodynamic lift generator, or by causing the boat or other tow craft B to travel at a greater speed. Thus, this invention can be implemented in sizes suited more to a novice or suited more to an advanced individual, by making appropriate adjustments to these parameters. Additionally, weight of a user U would be taken into account in any such sizing.

The wakeboard W can be replaced with a knee board, water ski or skis, hydroplaning water toy (i.e. an "Air Chair"), or an inner tube or other inflated towable apparatus. Also, the boat B can be replaced with a personal water craft. If the surface is snow instead of water, the planing apparatus could be a ski or skis, or could be a snowboard or other suitable snow planing apparatus. The tow vehicle could be a snowmobile, snow cat or car/truck, or other suitable vehicle capable of motion over the snow.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A towed participant entertainment system, comprising in combination:

a tow vehicle having a source of propulsion;

a tow rope coupled to said tow vehicle at a first end and including a handle at a second end opposite said first end, said handle adapted to be releasably held by a user;

at least one surface riding platform, said platform adapted to support a user thereon while said platform planes upon the surface;

an aerodynamic lift generator adapted to be coupled to the user and exert a lifting force upon the user;

said generator adapted to only be coupled to said tow rope through the user;

wherein a cord is interposed between said aerodynamic lift generator and the user, such that lift forces created by said aerodynamic lift generator are transferred to the user through said cord;

wherein a wearable garment is provided with said cord coupled to said wearable garment, said wearable garment adapted to be worn by the user; and wherein said wearable garment includes at least one leg girding belt and at least one torso girding strap, such that said wearable garment is at least partially in the form of a harness securely held to the user.

2. The system of claim 1 wherein said platform is a wakeboard, said surface is water and said tow vehicle is a boat, said wakeboard adapted to support a user standing thereon through at least one attachment boot.

3. The system of claim 1 wherein said platform is a knee board, said surface is water and said tow vehicle is a boat, said knee board adapted to support a user thereon in a kneeling position upon said knee board.

4. The system of claim 1 wherein said platform includes at least one ski, said ski adapted to support a user thereon through a foot of the user engaging at least one foot support on said at least one ski.

5. The system of claim 4 wherein said platform includes a pair of skis.

6. The system of claim 1 wherein said platform is a snowboard and said surface is snow, said snowboard adapted to support a user standing thereon through at least one attachment boot.

7. The system of claim 1 wherein said platform is a seat supported upon a hydroplaning base, wherein said surface is water and said tow vehicle is a boat.

8. The system of claim 1 wherein said platform is an air filled structure.

9. The system of claim 1 wherein said aerodynamic lift generator includes a parachute.

10. The system of claim 9 wherein said parachute includes vents therein, said vents located strategically within a canopy of said parachute, such that said parachute exhibits enhanced lift characteristics.

11. A towed participant entertainment system, comprising in combination:

a tow vehicle having a source of propulsion;

a tow rope coupled to said tow vehicle at a first end and including a handle at a second end opposite said first end, said handle adapted to be releasably held by a user;

at least one surface riding platform, said platform adapted to support a user thereon while said platform planes upon the surface;

an aerodynamic lift generator adapted to be coupled to the user and exert a lifting force upon the user;

said generator adapted to only be coupled to said tow rope through the user;

wherein said aerodynamic lift generator includes a parachute;

wherein said parachute includes vents therein, said vents located strategically within a canopy of said parachute, such that said parachute exhibits enhanced lift characteristics; and wherein said parachute includes a pair of stabilizers suspended by lines coupling said canopy to a junction of said lines, said pair of stabilizers adapted to resist rotation of said parachute.

12. The system of claim 1 wherein said generator includes a kite.

13. A towed participant entertainment system, comprising in combination:

a tow vehicle having a source of propulsion;

a tow rope coupled to said tow vehicle at a first end and including a handle at a second end opposite said first end, said handle adapted to be releasably held by a user;

at least one surface riding platform, said platform adapted to support a user thereon while said platform planes upon the surface;

an aerodynamic lift generator adapted to be coupled to the user and exert a lifting force upon the user;

said generator adapted to only be coupled to said tow rope through the user; and wherein said generator includes a balloon.

14. The system of claim 1 wherein said generator includes an at least partially rigid air foil.

15. The system of claim 14 wherein said air foil is a wing.

16. A towed participant entertainment system, comprising in combination:

a tow vehicle having a source of propulsion;

a tow rope coupled to said tow vehicle at a first end and including a handle at a second end opposite said first end, said handle adapted to be releasably held by a user;

at least one surface riding platform, said platform adapted to support a user thereon while said platform planes upon the surface;

an aerodynamic lift generator adapted to be coupled to the user and exert a lifting force upon the user;

said generator adapted to only be coupled to said tow rope through the user;

wherein a cord is interposed between said aerodynamic lift generator and the user, such that lift forces created by said aerodynamic lift generator are transferred to the user through said cord; and wherein said cord includes an outer end coupled to said aerodynamic lift generator and an inner end adapted to be coupled to the user, said inner end coupled to a retractor, said retractor adapted to retract portions of said cord between said inner end and said outer end.

17. The system of claim 16 wherein said retractor includes means to bias said cord toward being fully collected by said retractor, with said bias of said retractor exerting a cord retracting force less than a drag force of said aerodynamic lift generator, such that said aerodynamic lift generator causes said cord to extend away from said retractor when said tow vehicle is moving at a sufficient speed to cause said surface riding platform to plane on the surface, said bias exerting sufficient retracting force on said cord to collect said cord when no aerodynamic drag forces are exerted upon said aerodynamic lift generator, such as when the user is at rest.

18. The system of claim 17 wherein said bias of said retractor includes a torsion spring, one end of said torsion spring held fixed relative to the user and another end of said spring coupled to said inner end of said cord within said retractor.

19. The system of claim 18 wherein said spring is located within an enclosure and with said enclosure sized sufficient large to support both said spring and all of said cord therein when said cord is fully collected, said enclosure including a port therein from which said cord can extend out away from said retractor.

20. A towed participant entertainment system, comprising in combination:

a tow vehicle having a source of propulsion;

a tow rope coupled to said tow vehicle at a first end and including a handle at a second end opposite said first end, said handle adapted to be releasably held by a user;

at least one surface riding platform, said platform adapted to support a user thereon while said platform planes upon the surface;

an aerodynamic lift generator adapted to be coupled to the user and exert a lifting force upon the user;

said generator adapted to only be coupled to said tow rope through the user;

wherein a cord is interposed between said aerodynamic lift generator and the user, such that lift forces created by said aerodynamic lift generator are transferred to the user through said cord;

wherein a wearable garment is provided with said cord coupled to said wearable garment, said wearable garment adapted to be worn by the user; and wherein said wearable garment is at least partially formed of buoyancy enhancing material.

21. A towable apparatus jump enhancement system, comprising in combination:

an aerodynamic lift generator adapted to be coupled to the user and exert a lifting force upon the user;

said generator adapted to only be coupled to the user while the user holds a tow rope coupled to a tow vehicle;

wherein said aerodynamic lift generator includes a parachute;

wherein said parachute includes vents therein, said vents located strategically within a canopy of said parachute, such that said parachute exhibits enhanced lift characteristics; and wherein said parachute includes a pair of stabilizers suspended by lines coupling said canopy to a junction of said lines, said pair of stabilizers adapted to resist rotation of said parachute.

22. A towable apparatus jump enhancement system, comprising in combination:

an aerodynamic lift generator adapted to be coupled to the user and exert a lifting force upon the user;

said generator adapted to only be coupled to the user while the user holds a tow rope coupled to a tow vehicle;

wherein a cord is interposed between said aerodynamic lift generator and the user, such that lift forces created by said aerodynamic lift generator are transferred to the user through said cord; and wherein said cord includes an outer end coupled to said aerodynamic lift generator and an inner end adapted to be coupled to the user, said inner end coupled to a retractor, said retractor adapted to retract portions of said cord between said inner end and said outer end.

23. A method for enhancing a height and duration of jumps experienced by a user of a towable surface planing apparatus, the method including the steps of:

providing an aerodynamic lift generator;

coupling the generator to the user and not to any towing source;

towing the user upon the surface planing apparatus with a towing source;

exerting a lifting force on the user with the generator, such that any jumps experience greater height and duration; and wherein said coupling step includes the step of attaching a harness to the user including at least one leg girding belt and at least one torso girding strap, with the aerodynamic lift generator coupled to the harness.

24. A method for enhancing a height and duration of jumps experienced by a user of a towable surface planing apparatus, the method including the steps of:

providing an aerodynamic lift generator;

coupling the generator to the user and not to any towing source;

towing the user upon the surface planing apparatus with a towing source:

exerting a lifting force on the user with the generator, such that any jumps experience greater height and duration; and wherein said coupling step includes the further step of configuring the harness to be in the form of a vest formed of at least partially buoyancy enhancing material.

25. The method of claim 23 wherein said coupling step includes the step of extending a cord between said aerodynamic lift generator and the user with said cord precluded from being connected directly to a towing source.

26. A method for enhancing a height and duration of jumps experienced by a user of a towable surface planing apparatus, the method including the steps of:

providing an aerodynamic lift generator;

coupling the generator to the user and not to any towing source;

towing the user upon the surface planing apparatus with a towing source;

exerting a lifting force on the user with the generator, such that any jumps experience greater height and duration:

extending a cord between said aerodynamic lift generator and the user with said cord precluded from being connected directly to a towing source; and locating the aerodynamic lift generator adjacent the user, and deploying the aerodynamic lift generator to a location spaced from the user with the cord extending between the aerodynamic lift generator and the user.

27. The method of claim 26 including the further step of retracting the aerodynamic lift generator back to a location adjacent the use when no aerodynamic drag forces are exerted upon the aerodynamic lift generator, such as when the user is at rest.

* * * * *